US007226394B2

(12) United States Patent
Johnson

(10) Patent No.: US 7,226,394 B2
(45) Date of Patent: Jun. 5, 2007

(54) ROTARY REHABILITATION APPARATUS AND METHOD

(76) Inventor: Kenneth W. Johnson, 107 N. Pine St., Pittsburg, KS (US) 66762

( * ) Notice: Subject to any disclaimer, the term of this patent is extended or adjusted under 35 U.S.C. 154(b) by 422 days.

(21) Appl. No.: 10/687,207

(22) Filed: Oct. 16, 2003

(65) Prior Publication Data

US 2005/0085346 A1 Apr. 21, 2005

(51) Int. Cl.
*A63B 22/06* (2006.01)

(52) U.S. Cl. ..... 482/57; 74/594.3

(58) Field of Classification Search ..... 482/57, 482/63, 110; 74/597.1, 597.3, 597.4, 597.7, 74/594.1, 594.3, 594.4, 594.7
See application file for complete search history.

(56) References Cited

U.S. PATENT DOCUMENTS

| | | | | |
|---|---|---|---|---|
| 610,157 | A | 8/1898 | Campbelle | |
| 4,446,753 | A | 5/1984 | Nagano | |
| 4,509,742 | A * | 4/1985 | Cones | 482/58 |
| 4,606,241 | A | 8/1986 | Fredriksson | |
| 4,850,245 | A | 7/1989 | Feamster et al. | |
| 5,161,430 | A | 11/1992 | Febey | |
| 5,316,532 | A * | 5/1994 | Butler | 482/111 |
| 5,361,649 | A | 11/1994 | Slocum, Jr. | |
| 5,458,022 | A | 10/1995 | Mattfeld et al. | |
| 5,580,338 | A * | 12/1996 | Scelta et al. | 482/62 |
| 5,860,941 | A * | 1/1999 | Saringer et al. | 601/33 |
| 6,053,847 | A | 4/2000 | Sterns et al. | |
| 6,589,139 | B1 * | 7/2003 | Butterworth | 482/57 |

FOREIGN PATENT DOCUMENTS

| | | | |
|---|---|---|---|
| DE | 8519150 | U1 | 10/1985 |
| DE | 19947926 | A1 | 4/2001 |
| EP | 1034817 | A | 9/2000 |

* cited by examiner

*Primary Examiner*—(Jackie) Tan-Uyen Ho
*Assistant Examiner*—Tam Nguyen

(57) ABSTRACT

A rotary rehabilitation apparatus for rehabilitation of a person's extremity, including the joints and assorted muscles, tendons, ligaments, that can be tailored to the person's needs based upon their physical size, type of injury, and plan for recovery. The apparatus facilitates the adjustment of the range of motion of the user's extremity in a cycling action by offsetting a moveable lever from a fixed lever at a plurality of angles. As the user's extremity moves in a circular path, the extremity engages in extension and flexion to cause movements in the articulations formed at the user's joints.

7 Claims, 9 Drawing Sheets

ROTARY REHABILITATION APPARATUS AND METHOD

BACKGROUND OF THE INVENTION

1. Field of the Invention

This invention relates generally to the field of exercise and rehabilitation, and more specifically, to an apparatus providing selective adjustment of the range of motion of a user's extremities, including either arms and legs, actively engaging in or passively participating in a cycling action.

2. Description of the Related Art

One of the most significant and the most common athletic injuries is to the knee, and published data continues to report at an incidence of between one-quarter and one-third of all men and women experience some type of knee injury annually. Approximately 10.8 million individuals visit a physician for knee injuries alone each year. Total estimated annual U.S. costs of all musculoskeletal conditions is $254 billion. Many injuries to the lower extremities of persons necessitate the use of rehabilitation exercises. Such injuries may include those to the joints of a person's leg (e.g., knee, hip), replacement of one's joint (e.g., total hip or knee arthroplasty [THA, TKA]), ligaments or tendons associated with these joints (e.g., anterior cruciate or medial collateral ligament [ACL, MCL], or patella or quadricepts tendons), or muscles of the leg (e.g., Rectus or biceps femoris, etc). Rehabilitation exercises are also frequently prescribed after surgery has been performed to further repair an injured site on a user's extremity.

Major trunk injuries are also exceedingly common in the United States. Major trunk injuries include those injuries that affect the shoulders and back. The shoulder joint, being the most flexible joint in the human body, can be easily injured because of accidentally over-extending the range of motion. The U.S. Department of Labor estimates that thirty-five percent of all muscoskeletal injuries are major trunk injuries. Over four million visits are made to health care professionals each year because of shoulder injuries. Moreover, the U.S. Department of Labor estimates that the average time off-work for shoulder injuries is twelve days. This corresponds to an estimated $13–20 billion due to time lost from work.

One common rehabilitation exercise recommended to improve muscle, ligament and tendon strength, and endurance for extremities post-injury or post-surgically, is movement in a cycling motion. The movement of a person's upper or lower extremity in a circular path induces motion in the articulations that form the shoulder and elbow or hip and knee, respectively. However, for rehabilitation to be effective, it must be tailored to the specific needs of a given person based on their physical size, type of injury, and plan for recovery, among other factors. For example, if a surgical repair has been made to a torn ACL of a person's leg, it is often desirable at the beginning of a rehabilitation regimen to limit the flexion or extension of the knew, due not only to pain, but also to avoid damage to the repair. Likewise, for the shoulder, a physician may recommend limiting the motion of the shoulder to something far less than its full capability of 360 degrees until natural recovery and sufficient rehabilitation has occurred. Although cycle-type exercise machines are recommended for use in certain rehabilitation regimens, they generally do not facilitate the adjustment of the range of motion of one individual extremity. Further, these machines are limited to the standard pedal or handle arrangement where one lever (handle or pedal) is offset from the other by 180 degrees around a hub. There are, however, rehabilitation regimens where benefits to flexibility, strength, and/or endurance are achieved by offsetting levers or handles at another angles for passive, assisted active, and active range of motion.

SUMMARY OF THE INVENTION

A rotary rehabilitation apparatus is presented that allows for the selection of a range of motion for upper and/or lower extremities of a person engaging in a cycling action. The adjustable lever assembly allows for safer, more immediate rehabilitation following hip, knee, shoulder, and/or elbow injuries and further provides for pain reduction, increasing the range of motion, strengthening soft tissue and general conditioning. The assembly comprises one movable lever and a flywheel rotatably mounted on a support and having a series of bores along a diameter thereof with which the movable lever or handle is releasably mounted. In an exemplary arrangement where the rotary rehabilitation apparatus is incorporated with cycle-type exercise machine, for example a cycle ergometer, a user will sit on the seat and place their feet or hands on the levers to impart a force thereon. As the user's feet or hands move in a circular path, the extremities engage in extension and flexion to cause movement in the articulations formed at the user's hip and knee or shoulder and elbow joints. The amount of movement in the articulations of the extremity and consequently, the range of motion at these joints can be controlled by mounting the lever with the appropriate bore on the flywheel. If increased extension and flexion is desired, the lever can be mounted with a bore further away from the axis of rotation of the flywheel. Conversely, if a smaller degree of extension and flexion is preferred, the lever can be mounted with a bore closer to the flywheel axis of rotation.

In one configuration, the moveable lever is releasably mounted with a mounting bore of the flywheel and the other lever is left at full diameter. This configuration allows an adjustable range of motion for one extremity and a fixed range of motion for the other extremity, which allows for more limited, rehabilitative exercises for one extremity (e.g., an injured knee or shoulder) and more robust exercises for the other.

In another aspect, more than one series of bores extend across different diameters of the flywheel, so that the movable lever can be mounted at various angles with respect to the fixed lever around the axis of rotation. For example, while levers are typically aligned 180 degrees from one another around a hub on an cycle-type exercise machine, it may be desired in rehabilitation regimens to position the levers at a different angle to work on the passive range of motion ("PROM"), the assisted active range of motion ("AAROM"), and the active range of motion ("AROM").

The rotary rehabilitation apparatus of the present invention provides improved options for rehabilitation regimes where a cycling or rotary action would be beneficial to recovery from injury of a person's extremities. As a user progresses in their injury recovery, such as by increasing strength and flexibility in their extremities, the movable lever or handle can be disengaged and remounted within another bore that provides a different range of motion for their extremity when rotating the assembly.

By rapidly affecting PROM, AAROM and AROM this invention will reduce the time required to recover from extremity injuries, increasing improvements in measurable outcomes such as range of motion, edema, proprioception, return to unassisted gait activities, initial functional independent measures, strength and conditioning; reduce overall inpatient and outpatient costs, accelerate return to vocational or avocational activities; and significantly improve quality of life by expediting a return to autonomy.

DETAILED DESCRIPTION OF THE INVENTION

Figure 1B:
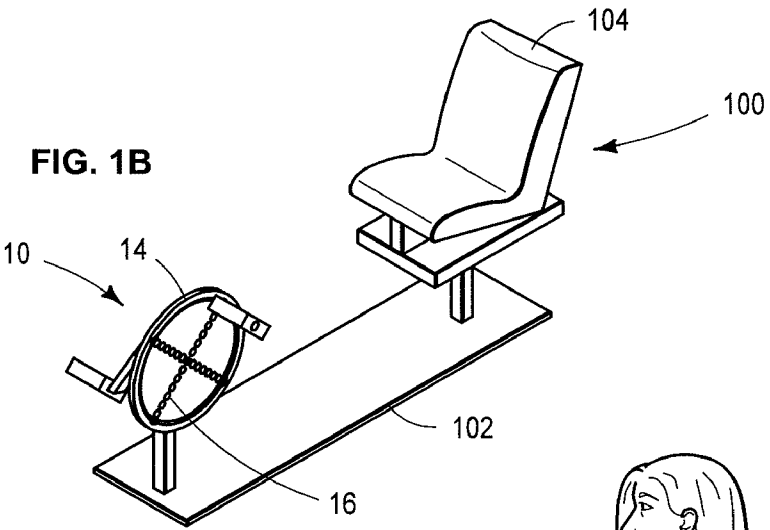
FIGS. 1A–1D show various views (right side elevation view, perspective view, top plan view and front elevation view) of the rotary rehabilitation apparatus of the present invention incorporated with a cycle-type exercise machine.
Figure 1A:
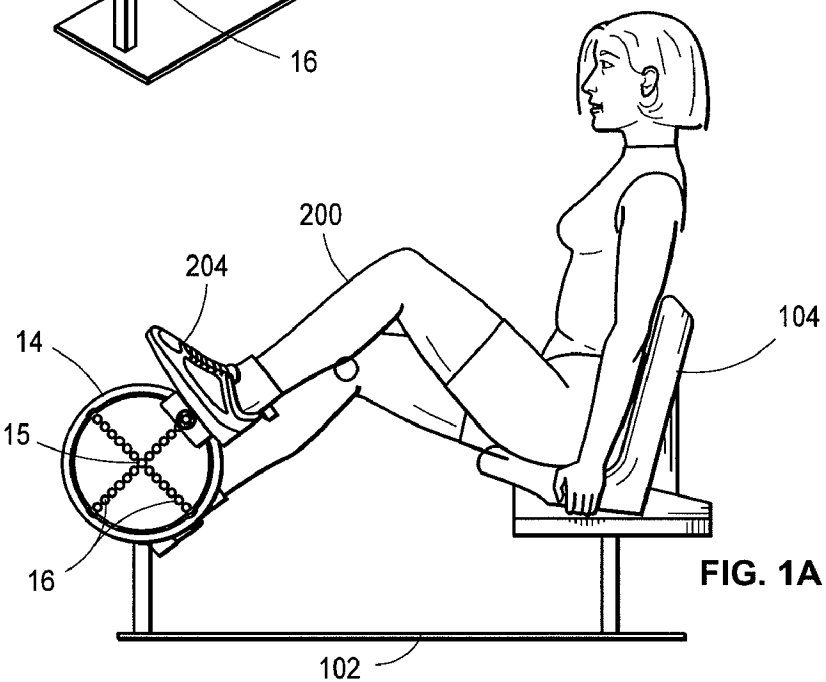
Figure 1C:
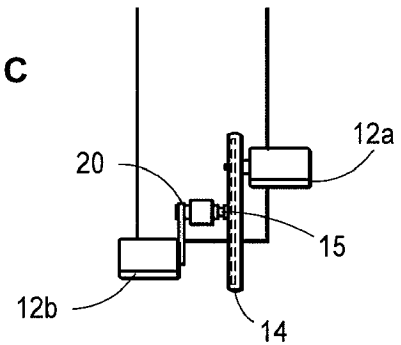
Figure 1D:
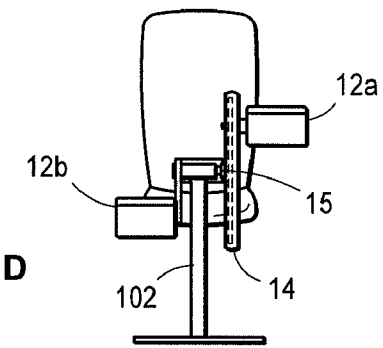
Figure 2A:
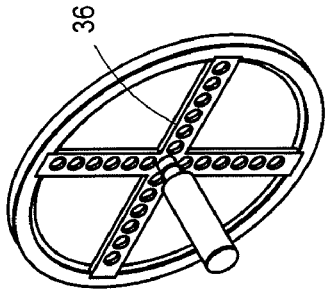
FIG. 2A is a left perspective view of the flywheel mounted with the hub.
Figure 2B:
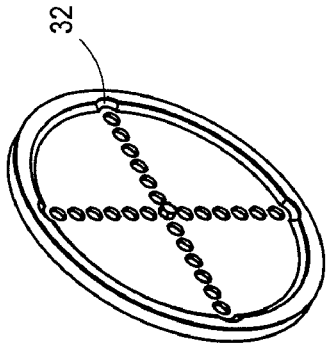
FIG. 2B is a right perspective view of the flywheel of FIG. 2A.
Figure 2E:
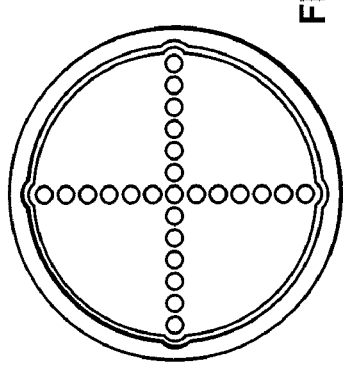
FIG. 2E is a right side elevation view of the flywheel.
Figure 2C:
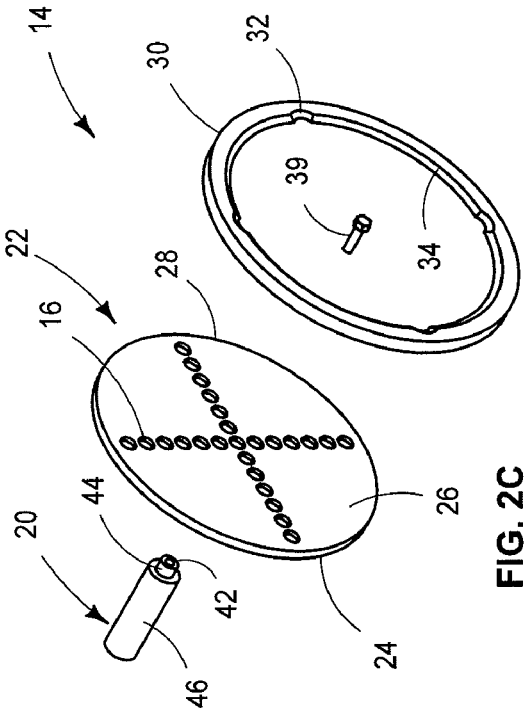
FIG. 2C is an exploded view of the flywheel as mounted with the hub.
Figure 2D:
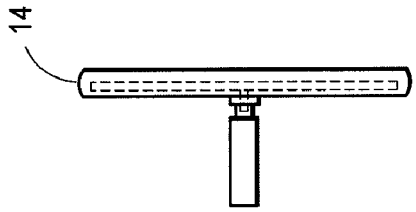
FIG. 2D is a front elevation view of the flywheel of FIG. 2A.
Figure 3A:
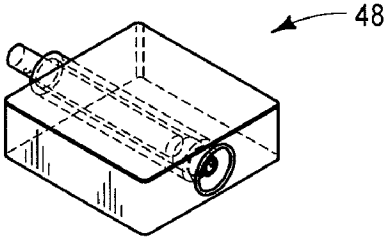
FIG. 3A is a perspective view of the pedal lever assembly.
Figure 3B:
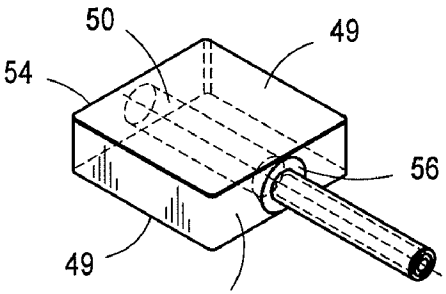
FIG. 3B is an exploded view of the pedal lever assembly.
Figure 3B:
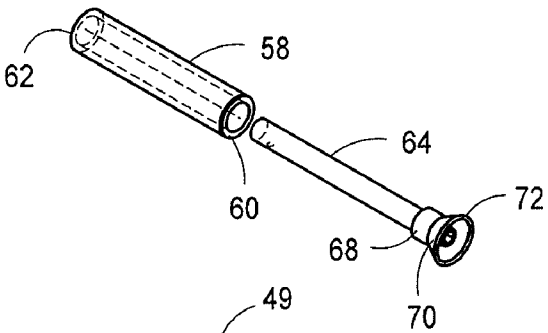
Figure 3E:
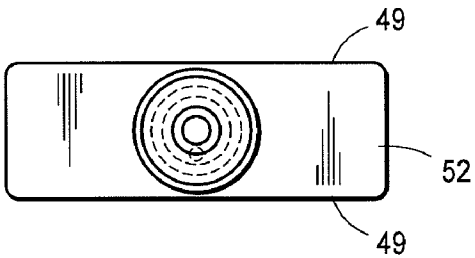
FIG. 3E is a right side elevation view of the pedal lever assembly.
Figure 3C:
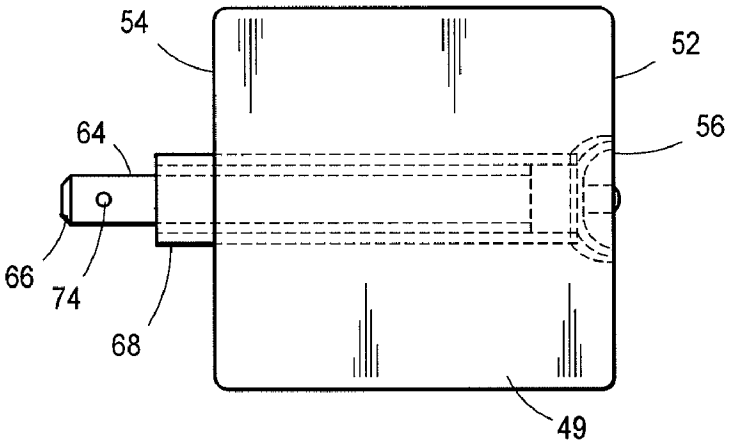
FIG. 3C is a top plan view of the pedal lever assembly.
Figure 3D:
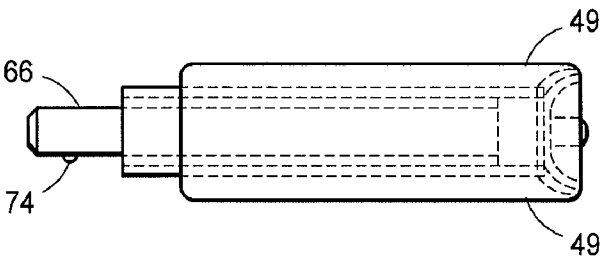
FIG. 3D is a front elevation view of the pedal lever assembly.
Figure 4A:
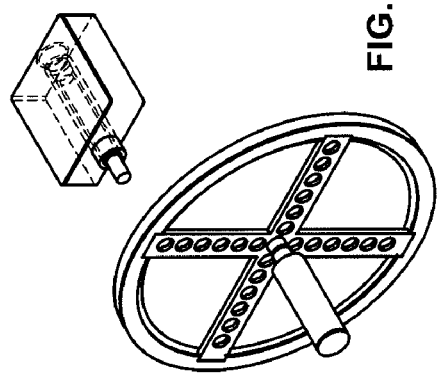
FIG. 4A is a left perspective view of the rotary rehabilitation apparatus showing one lever approaching engagement with one of the bores of the flywheel and the flywheel rotatably mounted with a hub.
Figure 4B:
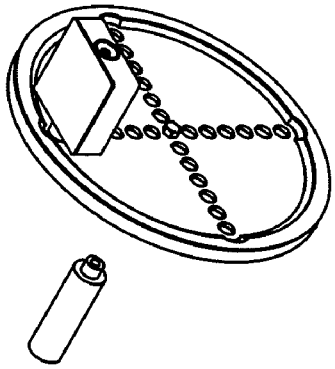
FIG. 4B is a right perspective view of the rotary rehabilitation apparatus showing the lever mounted with the flywheel and the hub with which the flywheel is mounted.
Figure 4E:
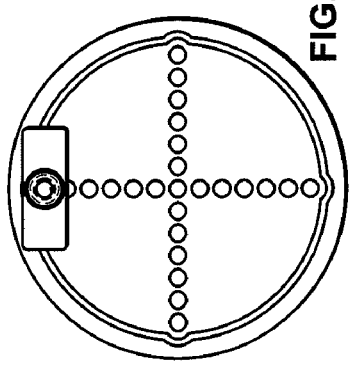
FIG. 4E is a right side elevation view of the rotary rehabilitation apparatus of FIG. 4C.
Figure 4C:
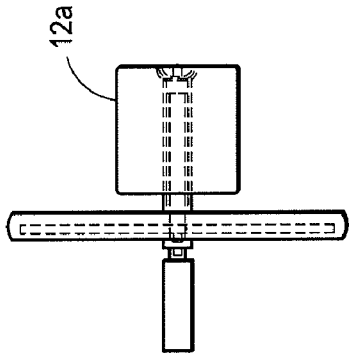
FIG. 4C is a top view of the rotary rehabilitation apparatus showing the lever mounted with the flywheel, and the flywheel mounted with the hub.
Figure 4D:
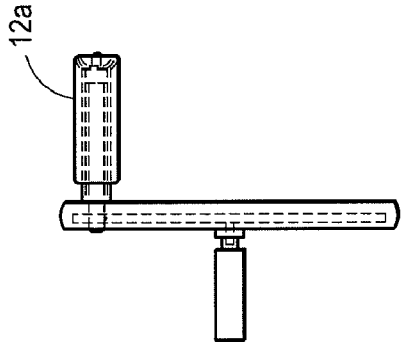
FIG. 4D is a front elevation view of the rotary rehabilitation apparatus of FIG. 4C.

One rotary rehabilitation apparatus 10 providing for the selection of a range of motion for one or both legs 200 of a person is shown in FIGS. 1A–1D. An embodiment of the rotary rehabilitation apparatus for rehabilitating a person's upper extremities will be discussed in detail below. The rotary rehabilitation apparatus 10 is shown incorporated in a cycle-type exercise machine 100 having a support 102 with an arm 102*a*, upon which the apparatus 10 is rotatably mounted and a seat 104, positioned at a distance from the support 102. In this arrangement, the person can sit in the seat 104, place their feet 204 on the levers 12*a* and 12*b* and impart a pushing force thereto with their legs 200 to rotate a flywheel 14 at a center point 15 thereof around an axis extending in the horizontal plane.

The adjustable range of motion for each leg 200 is achieved by having the movable lever 12*a* be repositionable along one or more diameters of the flywheel 14. The flywheel 14 has a series of bores 16 extending laterally therethrough parallel to the flywheel rotational axis and formed in a row along the flywheel diameter so that the lever 12*a* can be removably mounted with one of the bores 16. In the embodiment of the rotary rehabilitation apparatus 10 shown in FIGS. 1A–1D, the flywheel 14 has two separate series of bores 16 each aligned along one flywheel diameter and orthogonal to one another. As can also be seen, the movable lever 12*a* is mounted with the flywheel 14 and the fixed lever 12*b* is mounted with a crank 18 extending radially from a hub 20 with which the flywheel 14 is rotatably mounted at the center point 15. This configuration allows for lever adjustment both along the flywheel 14 diameter towards or away from the center point 15, and concentrically on the flywheel 14 around the center point 15 such that the lever 12*a* may be at an offset angle relative to the fixed lever 12*b* about the flywheel axis of rotation of 90, 180 or 270 degrees.

FIGS. 2A–2E show more detail of the flywheel 14 and mounting with the hub 20. The flywheel 14 comprises a circular disk 22 having opposing first and second planar surfaces 24, 26 and a perimeter edge 28, and a circumferential ring 30 fixed around the perimeter edge 28. The ring 30 may be press fit onto the disk perimeter edge 28 or may be mounted thereto with fasteners or adhesives. A first set of notches 32 are formed along an inner edge 34 of the ring 30 adjacent to the disk first planar surface 24 and in alignment with each row of the series of bores 16. These notches 32 facilitate the extension of brace members 36 across the disk planar surface 26 on a diameter of the ring 30 to matingly fit with the notches 32. A second set of notches 38 having a curved profile are formed along the ring inner edge 34 adjacent to the disk second planar surface 26. When the movable lever 12*a* is mounted with the bore 16 furthest from the center point 15, the notches 38 provide extra clearance such that the lever 12 fits properly adjacent to the second planar surface 26.

Depending on the functionality desired in the cycle-type exercise machine 100, the flywheel 14 can be designed to have a relatively large or small moment of inertia. A large moment of inertia flywheel 14 requires more peddling force to accelerate the same to a given speed, but also causes the flywheel 14 to better resist changes in speed, resulting in smoother "steady-state" cycling, which may be preferred in certain rehabilitation exercises. The higher moment of inertia is created by making the flywheel 14 heavier and/or moving more of the flywheel weight out to the circumferential ring 30.

The flywheel 14 is mounted with the hub 20 by insertion of a fastener 39 through the bore 16 of the disk 22 forming the center point 15 of the flywheel 14 and through a coupling 40 for securing with the hub 20. Specifically, the fastener 39 extends into a receiving bore 42 formed in a stem 44 rotatably mounted within a body 46 of the hub 20. In this arrangement, the hub body 46 is stationary on the support 102 while the hub stem and the mounted flywheel 14 rotate relative to the hub body 46. The hub 20 is preferably mounted adjacent to the first planar surface 24 on a side of the flywheel 14 opposite of the movable lever 12*a*.

In addition to controlling the moment of inertia in the flywheel 14, the overall resistance to turning of the flywheel 14 may be controlled to increase the amount of work a user must perform in peddling, as those of skill in the art appreciate with respect to known cycle-type exercise machines. For example, frictional resistance may be incorporated in to the design of the hub 20, such that the rotation of the stem 44 relative to the hub body 46 requires a certain amount of force to overcome the static and dynamic friction within the hub 20. Alternatively, a frictional surface (not shown), for example, a brake, may selectively engage the circumferential ring 30 to create static and dynamic friction.

FIGS. 3A–3E show the components of the movable lever 12*a*. The lever body 48 has opposing surfaces 49 onto which the user's foot is placed and a bore 50 extending through the body 48 from a lateral side face 52 to a medial side face 54. A chamfer 56 is also formed at the bore entrance of the lateral side face 52. A sleeve 58 has a first end 60 and a second end 62, and is configured for insertion into the bore 50 such that the second end 62 extends out of the lever medial side face 54. A pin 64 is inserted into the sleeve 58 and has a shank 66 extending out of second end 62 thereof, and a collar 68 having a concentric base 70 configured to abut the first end 60 and a beveled region 72 mateably fitting within the chamfer 56. A protrusion 74 is formed on the shank 66 near an end distal to the collar 68 such that the pin 64 frictionally fits within one bore 16 of the flywheel 14 to secure the lever body 48 thereto. If enough of a pulling force is applied to the lever body 48 away from the flywheel 14, the protrusion 74 is removed from the frictional fit in the bore 16 and may be repositioned as desired in another bore 16. The lever body 48 and sleeve 58 are also rotatable about the pin 64 such that as the flywheel 14 rotates, one of the peddling surfaces 49 is maintained in alignment such that the user can continue to apply a force thereto with their feet 204 through the cycling motion.

Figure 5B:
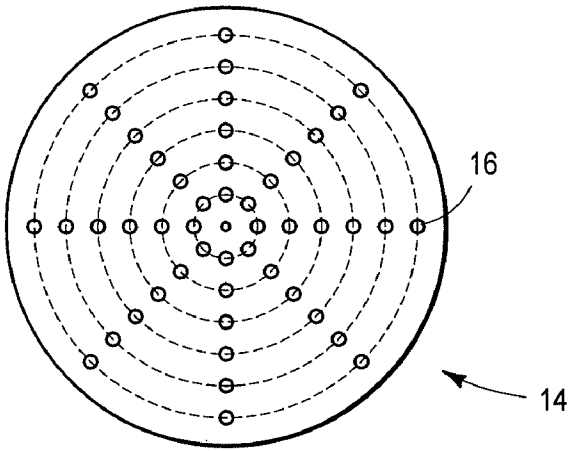
FIG. 5B is a side elevation view of another embodiment of the disk of the flywheel showing bores along four diameters thereof.
Figure 5A:
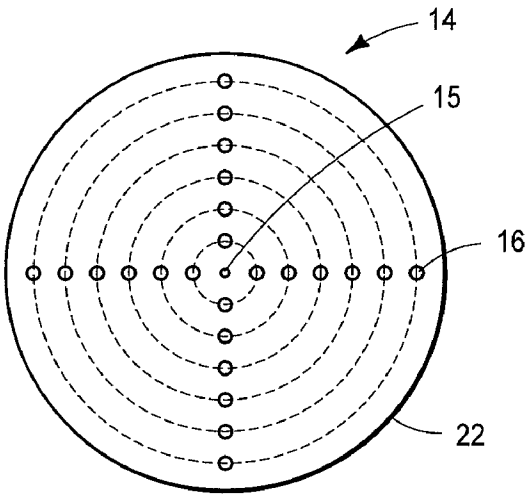
FIG. 5A is a side elevation view of one embodiment of the disk of the flywheel showing bores along two diameters thereof.
Figure 5C:
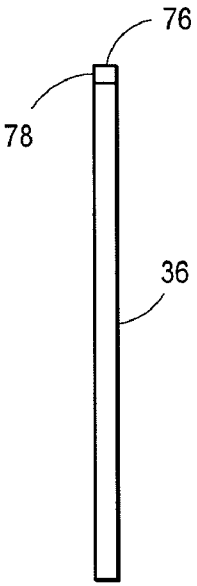
FIG. 5C is a side elevation view of one brace member of the flywheel.
Figure 5D:
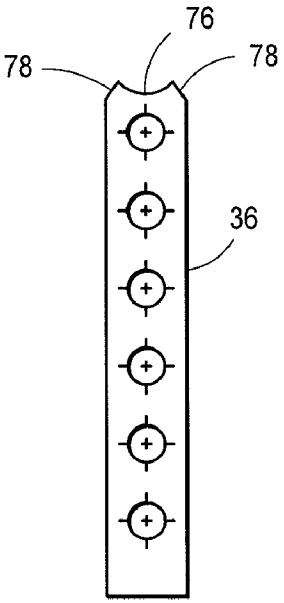
FIG. 5D is a front elevation view of the brace member of FIG. 5C.
Figure 5G:
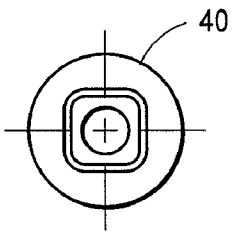
FIG. 5G is a front elevation view of the coupling of FIG. 5E.
Figure 5F:
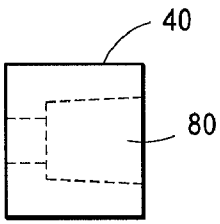
FIG. 5F is a side elevation view of the coupling of FIG. 5E.
Figure 5E:
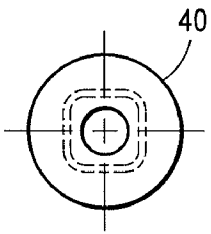
FIG. 5E is a rear elevation view of the coupling for mounting the hub with the flywheel.

FIGS. 4A–4E show an exemplary orientation for the rotary rehabilitation apparatus 10 where the movable lever 12*a* is shown mounting with one of the radially outermost bores 16 of the flywheel 14. In FIG. 5A, the embodiment of the flywheel 14 of FIGS. 1A–1D having two series of bores 16 is shown. Each concentric dotted line on the flywheel disk 22 connecting bores 16 on different rows represents a certain distance from the center point 15 (i.e., point of rotation) of then flywheel 14, for example, one inch. Thus, one can quickly determine the degree of adjustment achieved by mounting a movable lever 12*a* with one particular bore 16. FIG. 5B shows another flywheel 14 embodiment having four series of bores 16 with each row rotated 45 degrees with respect to one another. This arrangement allows for more fine-tuning of the angle offset between the movable lever 12*a* and the fixed lever 12*b*, which may be desired in certain rehabilitation regimens. FIGS. 5C and 5D show one brace member 36 having a curved edge 76 for abutting the coupling 40 on an end opposite of the notches 32 of the circumferential ring 30, and beveled edges 78 on either side of the curved edges 76. Each beveled edge 78 of one brace member 36 abuts a beveled edge 78 of another brace member 36 extending along an adjacent row of the series of bores 16. FIGS. 5E–5G also show the coupler 40 in detail. A cavity 80 is formed in the cylindrical coupler 40 and is shaped to receive the stem 44 of the hub 20. A bore extends from the cavity through the coupler 40 with a diameter sufficient to allow the fastener 38 to extend therethrough to reach the stem 44. In this way, the coupler 40 provides the interface to more securely mount the flywheel 14 for rotation about the hub body 46.

Figure 6B:
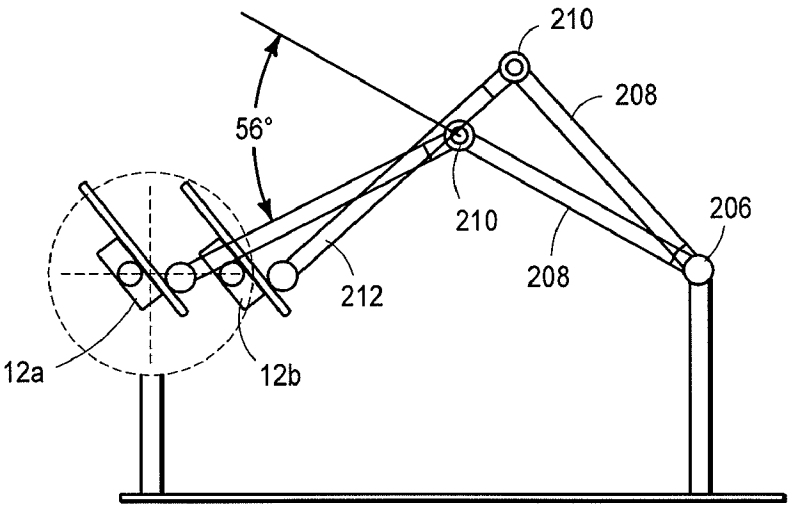
FIGS. 6A and 6B schematically show leg members having feet positioned on the levers of the rotary rehabilitation apparatus at a first position of rotation and at a second position of rotation.
Figure 6A:
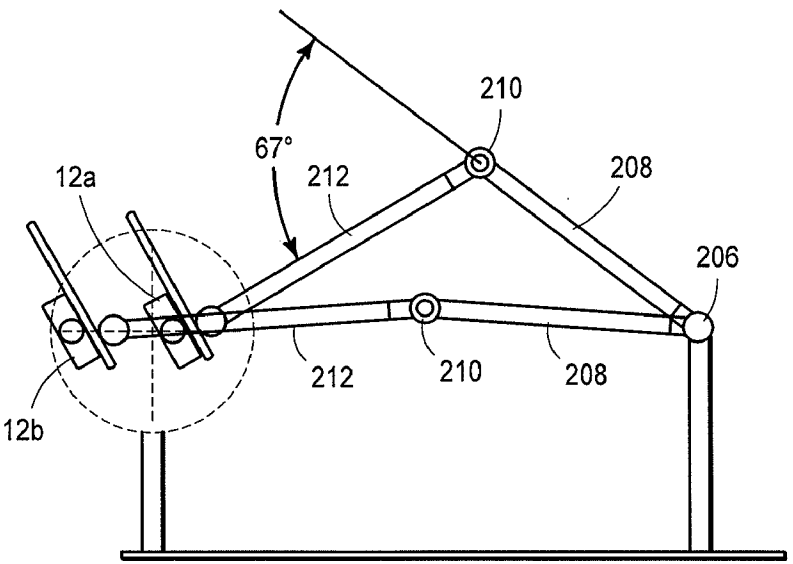
Figure 7B:
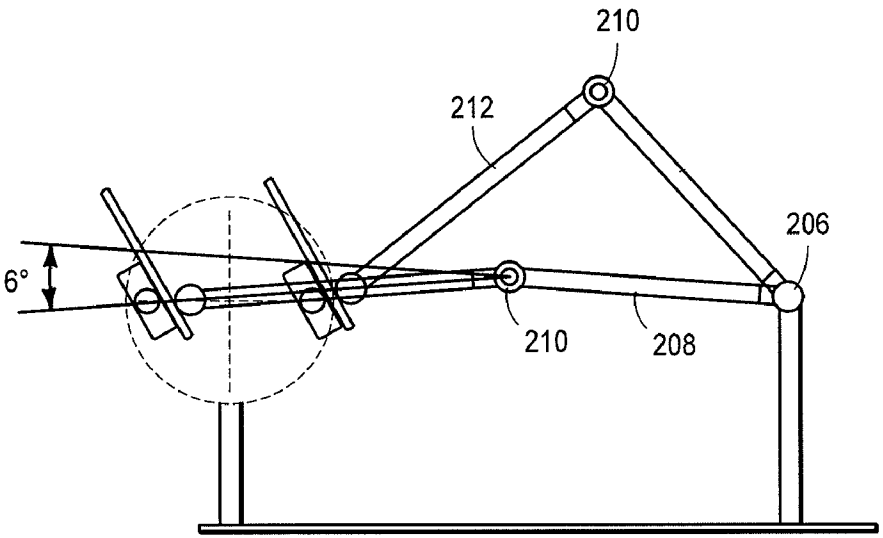
FIGS. 7A and 7B schematically show leg members having feet positioned on the levers of the rotary rehabilitation apparatus with one of the levers mounted at a different position on the flywheel than the levers of FIGS. 6A and 6B and the levers being at a first position of rotation and at a second position of rotation.
Figure 7A:
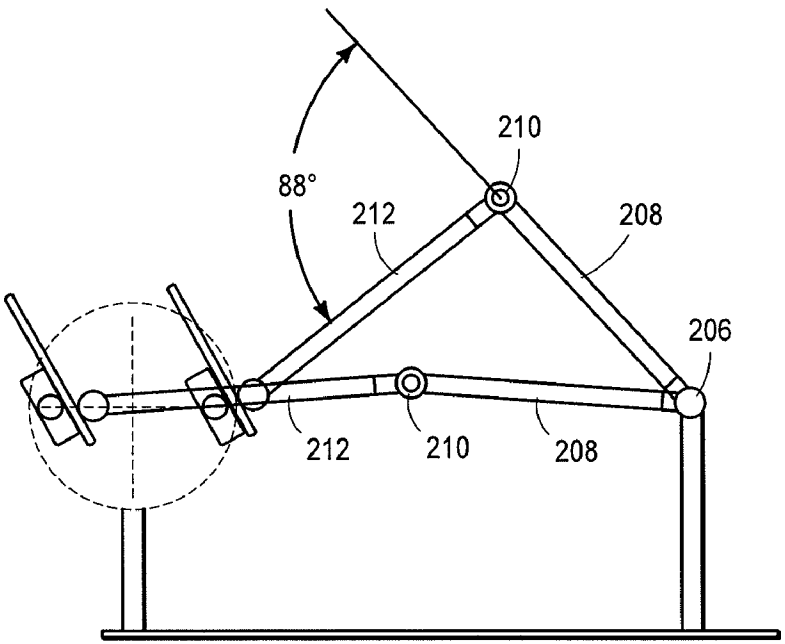

The motion of a person's legs 200 utilizing the rotary rehabilitation apparatus 10 of the present invention is simulated in FIGS. 6A–7B showing the hip joint 206, the upper leg 208 (e.g., the femur), the knee joint 210 and the lower leg 212 (e.g., the tibia). In FIGS. 6A and 6B, the fixed lever 12*b* is at a radial distance (e.g., 6 inches) from the flywheel 14 axis of rotation that is much greater that the radial distance of the movable lever 12*a* (e.g., 1 inch) from such axis of rotation. This provides a relatively large range of motion for the user's leg peddling the fixed lever 12*b* while providing a relatively small range of motion for the leg rotating the movable lever 12*a*. In this configuration, the movable lever 12*a* limits the change in angle formed between the lower leg 212 and a tangent extension of the upper leg 208 to 11 degrees, with the angles remaining between 67 degrees and 56 degrees.

This rehabilitation regimen may be recommended when the user is not to bend their leg to a certain degree, for example, to limit stresses on the hip 206 or knee 210. Conversely, in FIGS. 7A and 7B, the movable lever 12*a* and fixed lever 12*b* are at the same radial distance (e.g., 6 inches) from the flywheel 14 axis of rotation. Thus, both of the user's legs will participate in a large range of motion when peddling with the apparatus 10. The movable lever 12*a*, in the embodiment of FIGS. 7A and 7B, allows for the angle formed between the lower leg 212 and a tangent extension of the upper leg 208 to cycle between 6 degrees and 88 degrees. This large range of motion rehabilitation regimen brings about much more flexion and extension than the embodiment of FIGS. 6A and 6B, and consequently more movement of the hip and knee articulations. Thus, the embodiment of FIGS. 7A and 7B may be preferred during a later stage of injury or post-surgery rehabilitation when the flexibility and strength of the affected joint, for example, a user's ACL or total knee arthroplasty (TKA) has increased.

Figure 8:
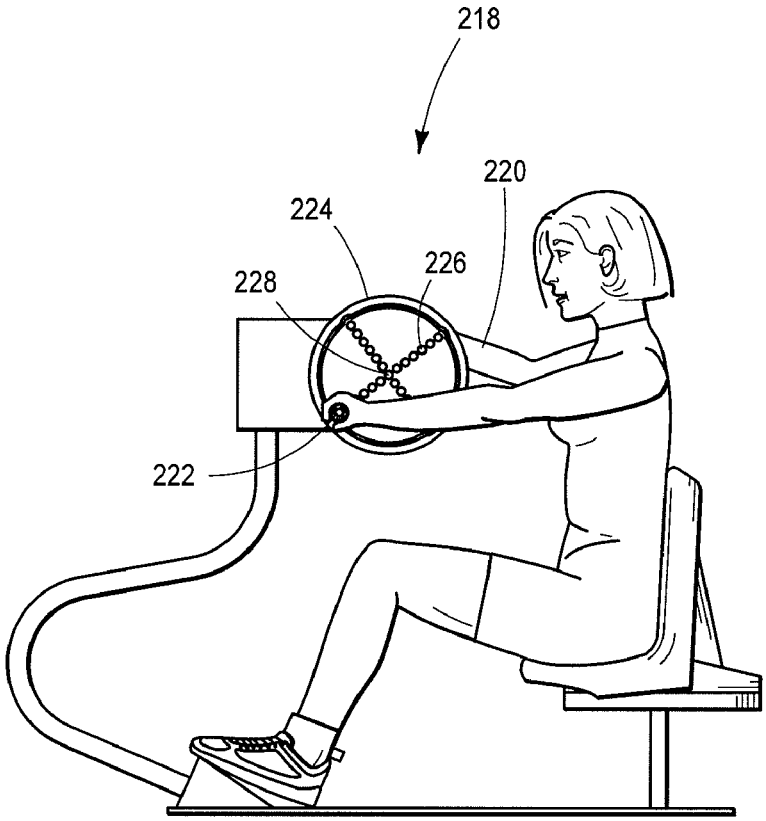
FIG. 8 is a right side elevation view of a rotary rehabilitation apparatus configured for upper extremity movement of the shoulder and/or elbow.
Figure 9A:
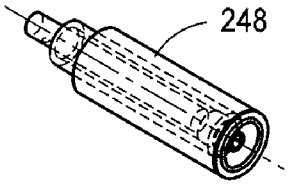
FIGS. 9A–9E show various views (perspective view, exploded perspective view, right side elevation view, top plan view and front elevation view) of the lever assembly of a rotary rehabilitation apparatus of the present invention.
Figure 9B:
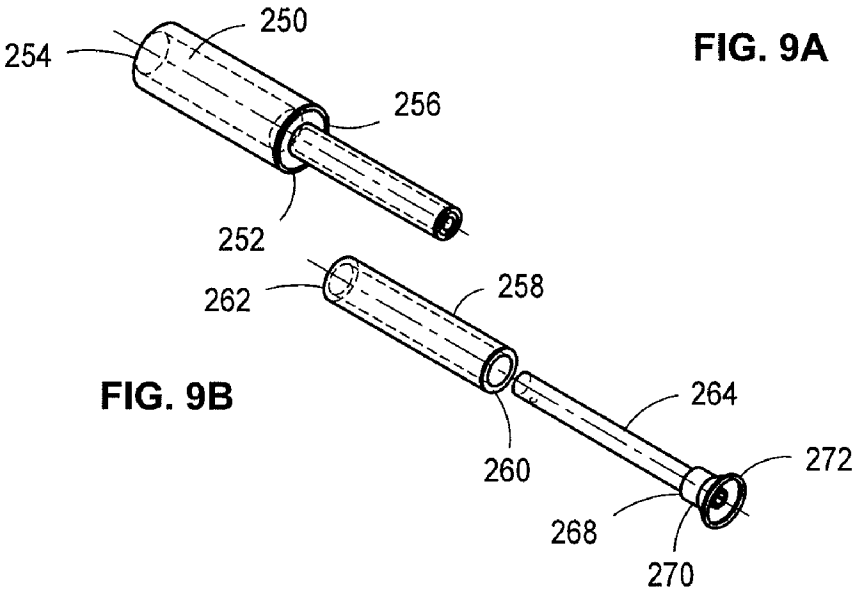
Figure 9E:
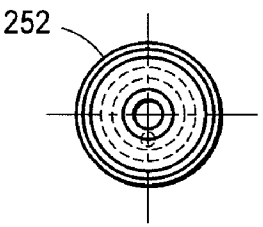
Figure 9C:
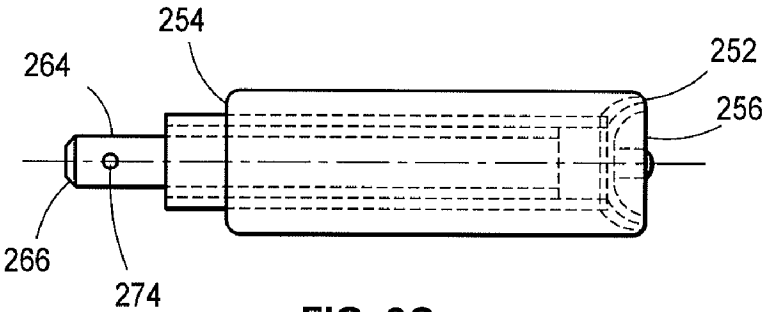
Figure 9D:
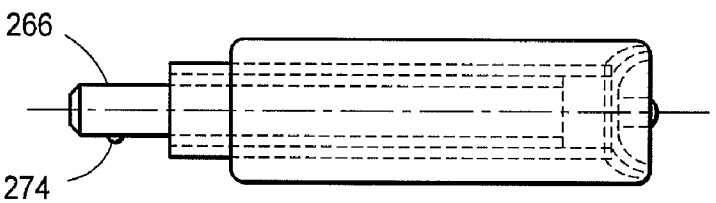

In the embodiment of the rotary rehabilitation apparatus 218 shown in FIG. 8, for upper extremities including the shoulder, wrist and elbow, the adjustable range of motion for each arm 220 is achieved by having the movable hand lever 222 be repositionable along one or more diameters of the flywheel 224. The flywheel 224 has a series of bores 226 extending laterally therethrough parallel to the flywheel rotational axis and formed in a row along the flywheel diameter so that the hand lever 222 can be removably mounted with one of the bores 226. In the embodiment of the rotary rehabilitation apparatus 218 shown in FIG. 8, the flywheel 224 has two separate series of bores 226 each aligned along one flywheel diameter and orthogonal to one another. Not shown in FIG. 8, but comparably configured as in FIGS. 1A–1D, is a fixed hand lever on the opposite side of the flywheel 224 mounted to a crank extending radially from a hub with which the flywheel 224 is rotatably mounted at the center point 228. This configuration allows for lever adjustment both along the flywheel 224 diameter towards or away from the center point 228, and concentrically on the flywheel 224 around the center point 228 such that the hand lever 222 may be at an offset angle relative to the fixed hand lever about the flywheel axis of rotation of 90, 180 or 270 degrees.

FIGS. 9A–9E show the components of the movable hand lever 222. The hand lever body 248 may be tubular in shape or have other configurations that readily accommodate gripping by the human hand. The hand lever has a bore 250 extending through the body 248 from a lateral side face 252 to a medial side face 254. A chamfer 256 is also formed at the bore entrance of the lateral side face 252. A sleeve 258 has a first end 260 and a second end 262, and is configured for insertion into the bore 250 such that the second end 262 extends out of the lever medial side face 254. A pin 264 is inserted into the sleeve 258 and has a shank 266 extending out of second end 262 thereof, and a collar 268 having a concentric base 270 configured to abut the first end 260 and a beveled region 272 mateably fitting within the chamfer 256. A protrusion 274 is formed on the shank 266 near an end distal to the collar 268 such that the pin 264 frictionally fits within one bore 226 of the flywheel 224 to secure the hand lever body 248 thereto. If enough of a pulling force is applied to the hand lever body 248 away from the flywheel 224, the protrusion 274 is removed from the frictional fit in the bore 226 and may be repositioned as desired in another bore 226. The lever body 248 and sleeve 258 are also rotatable about the pin 264 such that as the flywheel 224 rotates, the lever body and sleeve also rotate such that the user can continue to apply a force thereto with their hands and arms through the rotary motion.

What is claimed is:

1. An apparatus providing an adjustable range of motion for an extremity of a user, comprising:

a support including an arm extending therefrom;

a flywheel rotatably mounted on the arm for rotation about a first axis, the first axis being at least substantially perpendicular to the arm, the flywheel having a first plurality of horizontally aligned bores disposed along a diameter thereof;

a first lever configured for being releasably mounted in one of the bores of the first plurality of bores on a side of the flywheel, such that releasably mounting the first lever in a different bore of the plurality of bores changes the path of motion of the user's extremity positioned on the first lever thereby altering the range of motion of the articulation forming the user's joints on the respective extremity of the user;

a seat positioned rearward of the flywheel, the seat at substantially the same elevation as the flywheel, such that a user seated on the seat may place one of their extremities on the first lever to rotate the flywheel;

a hub in operative communication with the support, the hub including a rotatable member for imparting rotational motion to the flywheel, about a second axis, the second axis being at least substantially coaxial with the first axis; and, a crank in operative communication with the rotatable member of the hub, the crank being positioned on a side of the flywheel opposite of the first lever.

2. The apparatus of claim 1, further comprising:

a second lever rotatably mounted with the crank such that a user may rotate the flywheel by imputing forces on the first lever and second lever with the extremity.

3. The apparatus of claim 1, further comprising a second plurality of horizontally aligned bores bisecting the first plurality of bores on the flywheel, along a diameter thereof, the second plurality of bores extending orthogonally from the first plurality of bores.

4. The apparatus of claim 1, further comprising a plurality of horizontally aligned bores bisecting the first plurality of bores on the flywheel along a diameter thereof, each of the plurality of bores in linear alignment at an angle with respect to the other plurality of bores.

5. The apparatus of claim 1, wherein the first lever has a bore extending laterally from a medial lever side face to a lateral lever side face opposite thereof, the means for releasably rotatably mounting the first lever with one bore comprises:

a sleeve configured to fit within the lever bore; and a pin insertable through the sleeve on the lateral lever side face and extending out of the medial lever side face, the pin having a protrusion for engaging with one horizontally aligned bore of the flywheel.

6. The apparatus of claim 1, wherein the flywheel comprises:

a circular plate having opposing planar surfaces and a perimeter edge;

a ring sized to fit around the perimeter edge of the circular plate and having an inner edge; and a brace member extending across one of the planar surfaces of the plate to span the inner diameter of the ring.

7. A method for selectively adjusting the range of motion of articulations formed from the joints of an extremity of a user engaging in a cycling action, comprising the steps of:

providing a seat whereon a user may sit;

providing a support including an arm extending therefrom;

providing a flywheel rotatably mounted on the arm, the flywheel positioned forward from the seat, the flywheel configured for rotation about a first axis, the first axis being substantially perpendicular to the arm, and the flywheel having a first plurality of bores extending in a direction parallel to the axis of rotation and disposed along a diameter of the flywheel;

positioning the seat such that the seat is at least at substantially the same elevation as the flywheel:

providing a lever configured for releasably mounting with one of the bores of the flywheel;

providing a hub in operative communication with the support, the hub including a rotatable member for imparting rotational motion to the flywheel about a second axis, the second axis being at least substantially coaxial with the first axis;

providing a crank in operative communication with the rotatable member of the hub, the crank being positioned on a side of the flywheel opposite of the first lever;

mounting the lever with one particular bore of the flywheel to select the desired articulating motion of the user's joints on the respective extremity of the user when the user's extremity is placed on to lever and a force is applied thereto; and, creating a force on the crank to activate the hub and impart rotational motion to the flywheel.

* * * * *